US005400475A

United States Patent [19]

Hille

[11] Patent Number: 5,400,475

[45] Date of Patent: Mar. 28, 1995

[54] NONWOVEN LAYING DEVICE HAVING DOWNWARD ANGLED CONVEYOR AT DELIVERY CARRIAGE

[75] Inventor: Eduard Hille, Duelmen, Germany

[73] Assignee: Hergeth Hollingsworth GmbH, Duelmen, Germany

[21] Appl. No.: 234,436

[22] Filed: Apr. 28, 1994

Related U.S. Application Data

[63] Continuation of Ser. No. 927,400, Sep. 29, 1992.

[30] Foreign Application Priority Data

Mar. 30, 1990 [DE] Germany ..... 40 101 74.6

[51] Int. Cl.[6] ..... D01G 15/44; D01G 25/00

[52] U.S. Cl. ..... 19/163; 270/31

[58] Field of Search ..... 19/163, 300, 302; 270/31; 28/107; 226/113

[56] References Cited

U.S. PATENT DOCUMENTS

| | | | |
|---|---|---|---|
| 2,428,709 | 10/1947 | Hlavaty | 19/163 |
| 3,558,029 | 1/1971 | Manns | 19/163 X |
| 4,308,640 | 1/1982 | Bulla et al. | 19/196 |
| 4,357,739 | 11/1982 | Hille | 19/163 |
| 4,830,351 | 5/1989 | Stanislaw | 19/163 X |
| 4,984,772 | 1/1991 | Freund | 19/163 X |
| 5,285,554 | 2/1994 | Jean et al. | 19/163 |

FOREIGN PATENT DOCUMENTS 2553102 4/1986 France .

*Primary Examiner*—Clifford D. Crowder
*Assistant Examiner*—John J. Calvert
*Attorney, Agent, or Firm*—Leatherwood Walker Todd & Mann

[57] ABSTRACT

In a nonwoven laying device having at least two reciprocating carriages to be accelerated at the reversal points of their moving path, namely an upper carriage and a laying carriage, and having at least two circulating conveyor belts to be guided by guide rollers of the carriages, namely a main conveyor belt and a guiding conveyor belt, the upper carriage having at least two guide rollers. The guide rollers are laterally displaced and are set at different elevations so as to form a descending path for at least one of the conveyor belts. The path having an acute angle to the horizontal. Both belts facing each other forming an opening angle from 20° to over 90°. The angle is adjustable through adjustable rollers in the carriage.

14 Claims, 7 Drawing Sheets

NONWOVEN LAYING DEVICE HAVING DOWNWARD ANGLED CONVEYOR AT DELIVERY CARRIAGE

BACKGROUND OF THE INVENTION

This application is a continuation of application Ser. No. 07/927,400, filed Sep. 29, 1992.

The invention is directed to a process for laying a nonwoven or the like and a nonwoven laying device.

Nonwoven laying devices of the above type are used for laying nonwovens, fiber fleeces, spunbonded fabrics and the like, especially when delivered by a carding machine or the like, onto a discharge belt moved at a predetermined variable speed. In doing so, the nonwoven fiber fabric delivered by the carding machine is conveyed by a feed belt driven at a predetermined speed. Usually, within the nonwoven laying device, the nonwoven fiber fabric is at least partially transported between two conveyer belts moving at the same speed. These conveyer belts are provided as endless conveyer belts. For laying the nonwoven fiber fabric with maximum accuracy, nonwoven laying devices of the said type require reciprocating carriages having guide rollers for the conveyer belts arranged therein.

In nonwoven laying devices, particularly those operating at high speed, the sudden changes in speed of the carriages can result in uneven stretching of the nonwoven fiber fabric, caused by time differences in adjusting the speeds of the carriages and the conveyer belts due to the resilience of the frame and the working components.

Therefore, upon sudden acceleration of the conveyer belt, the nonwoven fiber fabric cannot follow up immediately. In nonwoven laying devices, it is essential that the conveyer belts and the carriages are controlled in such a manner relative to each other that the laying is effected with maximum uniformity.

In other known arrangements of nonwoven laying devices, the high acceleration rates upon reversal can be reduced by slowing down the process of reversal. These solutions, however, are disadvantageous because the nonwoven is supplied to the nonwoven laying device at a constant speed, and, necessitated by the coupled drive of the carriages, also has to be released at a constant speed. Thus, the reversal time must be theoretically zero which is practically impossible.

From EP-A-0 315 930, a nonwoven laying device is known wherein the upper carriage and the laying carriage have a common or also a separate drive for moving the carriages at different speeds in opposite directions. The upper carriage always moves at half the speed of the laying carriage and, in doing so, covers half the distance of the laying carriage. The drive is provided as a servo drive and is connected to a freely programmable control means. Therefore, the speed of the carriages can be changed as desired by setting their moving path, while also the acceleration periods in the reversal points of the traveling movement are variable as desired. The discharge speed of the nonwoven fiber fabric always corresponds to the intake speed of the nonwoven.

From FR-2 234 395, there is known a nonwoven laying device comprising an upper carriage and a laying carriage as well as a plurality of auxiliary carriages, wherein the upper carriage is reciprocated at a speed u while the laying carriage is reciprocated at a selected speed w. The relation of the carriage speeds with respect to each other under consideration of the woven supply speed V results from the equation $2 \cdot u \cdot w + |w| = V$. Due to this rule, no stuffing or stretching of the nonwoven shall occur. A variable setting of the speed relation between the upper carriage and the laying carriage is not described.

DE-A-26 09 396 discloses an endless rotating control chain coupling an upper carriage and a laying carriage and a storage carriage to each other. This endless rotating control chain is driven by chain wheels. Drive and control of the laying carriage, however, are performed by a separate carriage-drawing chain. Further, the laying carriage and the upper carriage are connected to each other by a tentering chain. Also, a measuring chain is required for the controlling.

Drive and control of this nonwoven laying device are very bothersome and nonetheless do not make it possible to set the stretching as desired.

From DE-18 21 234 U, it is known to couple the upper carriage and the laying carriage with each other by a power transmission element.

From DE-25 42 274 B, it is known to drive a laying carriage by a device operating according to the linear motor principle.

SUMMARY OF THE INVENTION

It is the object of the invention to provide a process for laying nonwovens or the like and a nonwoven laying device in such a manner that, in case of laying speeds below the belt intake speed, the nonwoven can be laid down also with a stretching (positive stretching), and in case of laying speeds above the belt intake speed, the nonwoven can be laid down also with a stuffing effect (negative stretching).

The object is solved by the features of the claims.

The speed of the laying carriage can be adjusted to be higher or lower than the intake speed of the nonwoven so as to obtain stuffing or stretching of the nonwoven upon laying. Also, adjustment of intermediate values or stretching or stuffing being non-uniform over the laying width are possible. In extreme cases, it is also possible to change the discharge speed of the nonwoven at the laying carriage to zero. In doing so, it is essential that the nonwoven can be laid also with a stretching when laying speeds are below the belt intake speed, and the fabric can be laid also with a stuffing effect when laying speeds are above the belt intake speed.

In an advantageous manner, the invention makes it possible to operate with a stretching even in the reversal areas wherein the laying speed of the laying carriage has to be decreased to zero until the reversal point has been reached and, from then on, has to be increased again, it being even possible to effect a controlled thinning of the nonwoven in the edge region thereof, which is advantageous in subsequent processing.

Advantageously, by the fact that the upper carriage, the laying carriage and the tensioning carriage are coupled through a single power transmission element in connection with two drives acting on said power transmission element, movement of the upper carriage and the laying carriage can be controlled independently of each other. Particularly, it is possible to increase or decrease the belt speed at the laying location without simultaneously increasing or decreasing the speed of the laying carriage. In this manner, stretching (or stuffing, respectively) e.g. of ±15% can be set without tilting. The two drives for movement of the upper carriage and the laying carriage are controlled by a computer.

This makes it possible that laying of the non-woven fleece is performed without stretching, with stuffing effect or with stretching effect while being controlled as desired, with speed differences provided between the belt speed and the laying carriage speed.

By the tensioning carriage, the main conveyer belt is kept tensioned at all times. The tensioning carriage is brought into its respective position by the power transmission element and thus does not need a separate drive.

In an alternative embodiment, it is provided that, instead of using drive means for the carriages, driving is performed by guide rollers for the main conveyer belt, which guide rollers are arranged before and behind the laying carriage, respectively. Thereby, a stretching can be set directly through the difference of the peripheral speeds of the guide rollers. Movement of the carriages is effected exclusively by the belt drive and the coupling through a power transmission element connecting the upper carriage, the laying carriage and the tensioning carriage.

In a further embodiment, the upper carriage and the laying carriage are provided with an electronically controlled linear drive, respectively, and the upper carriage, the laying carriage and the tensioning carriage are interconnected by a sole power transmission element. In an alternative embodiment of the invention, it is provided that the tensioning carriage consists of two spaced carriage members, each of them supporting a guide roller for one of the conveyer belts.

In this embodiment, one or a plurality of intermediate carriages are arranged between the upper carriage and the laying carriage. These intermediate carriages offer the advantage of distributing the stretchings and accelerations among several machine components.

Embodiments of the invention will be explained in greater detail hereunder with reference to the drawings.

DESCRIPTION OF A PREFERRED EMBODIMENT

Figure 2:
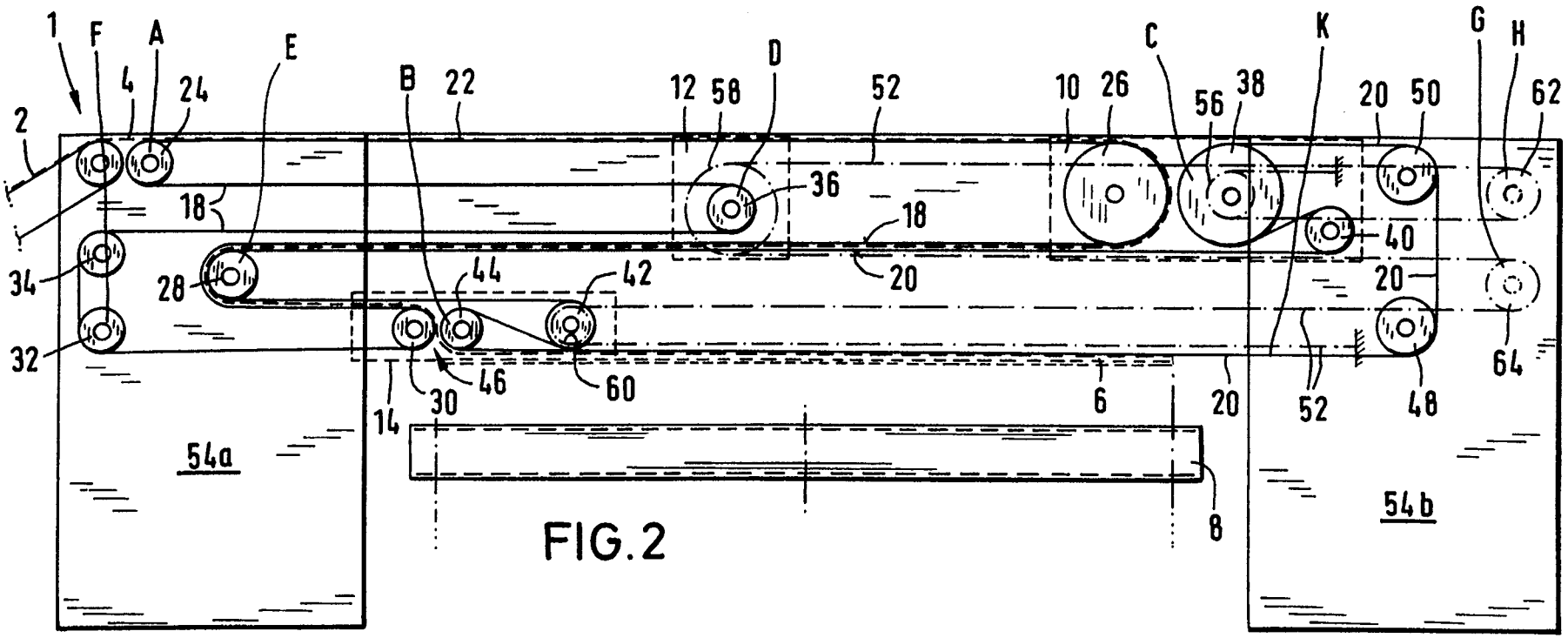
FIG. 2 shows a first embodiment of the invention.

The nonwoven laying device 1 as shown in FIG. 2 is provided. with a feed belt 2 by which a fiber fleece or nonwoven 4 or the like is supplied at a constant but variable speed of e.g. 1.5 m/sec from a carding machine arranged therebefore.

A discharge belt 6 is arranged on guide rollers 8 transverse to the feed direction of the feed belt 2, laying being performed onto said discharge belt 6 transversely and in zig-zag movement with respect to the feed direction. Instead of a transverse discharge belt 6, there can also be provided a discharge belt 6 running in lengthwise direction, i.e. in the same direction as the feed belt 2. The nonwoven laying device 1 has three carriages, namely an upper carriage 10, a tensioning carriage 12 and a laying carriage 14. Further, the nonwoven laying device 1 includes two endless conveyer belts 18 and 20 for receiving the non-woven at least partially therebetween and for transporting and guiding the fabric.

In the area of the nonwoven intake 22, the first conveyer belt 18 takes over the nonwoven 4 from the feed belt 2. In this location, a guide roller 24 is provided for simultaneously driving the first conveyer belt 18. The belt speed of conveyer belt 18 is determined by the carding machine. From the nonwoven intake 22, the conveyer belt 18 first reaches a guide roller 26, rotated, or pivoted, on a reciprocating upper carriage 10, which redirects the conveyer belt 18 by 180° and guides it back to a stationary guide roller 28 for the first conveyer belt 18, said stationary guide roller 28 being pivoted on a machine frame 54*b* on the feed-in side. By this renewed redirecting by 180°, the conveyer belt is guided to the reciprocating laying carriage 14 being moved back and forth over the set laying width.

The laying carriage 14 is provided with a guide roller 30 for the first conveyer belt 18 from where the first conveyer belt 18 returns to the nonwoven intake 22. During this process, the conveyer belt 18, via at least one stationary guide roller 32,34 pivoted e.g. in the machine frame 54*a*, is again redirected by 180° and fed to the reciprocating tensioning carriage 12.

By means of the guide roller 36 pivoted on the tensioning carriage, the first conveyer belt is finally supplied to the first guide roller 24.

The second endless conveyer belt 20, circulating at the same speed as the first conveyer belt, is redirected—by a guide roller 38 pivoted on upper carriage 10—in such a manner that the nonwoven 4 fed from nonwoven intake 22 is guided and moved between the guide roller 26 and the guide roller 38 of upper carriage 10. As FIG. 2 shows, the conveyer belt 20 is redirected by a further upper carriage guide roller 40 into the same direction into which the first conveyer belt 18 is redirected by guide roller 26, so that the nonwoven 4 is guided between the two conveyer belts 18 and 20 and about the guide roller 28 to the guide roller 30 of the laying carriage. By two laying carriage guide rollers 42,44, pivoted in laying carriage 14, conveyer belt 20 is redirected two times while the second guide roller 44, together with guide roller 30 of the laying carriage, again and for a last time guides the nonwoven 4 between the two conveyer belts 18,20 at the discharge site 46 of fabric 4. Return of conveyer belt 20 to guide roller 38 of upper carriage 10 is performed, in a manner similar to conveyer belt 18, by at least one stationary guide roller 48,50.

Figure 1:
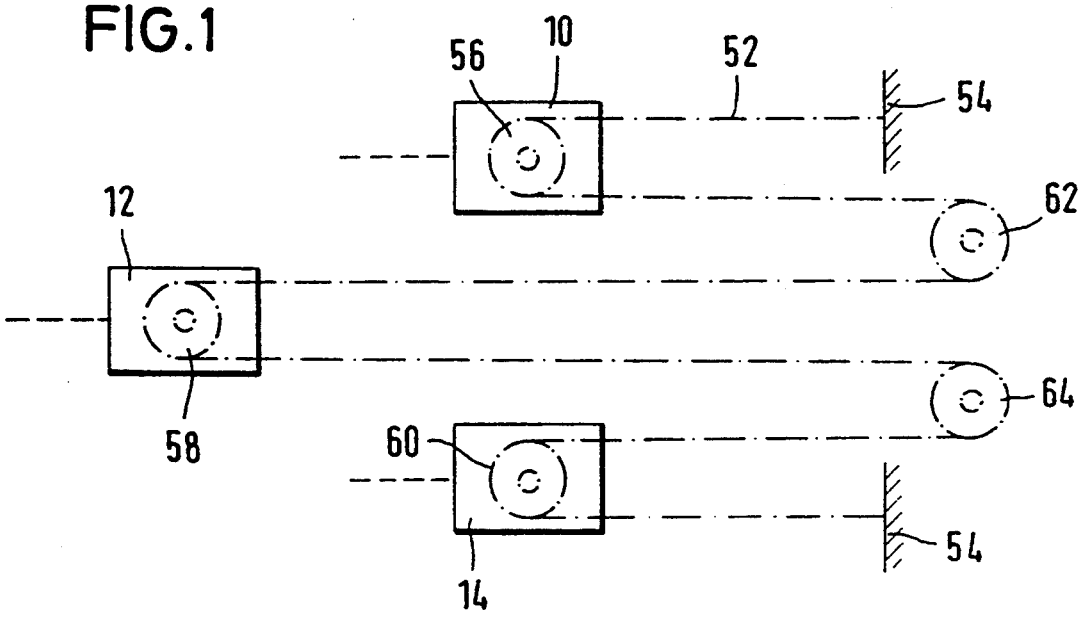
FIG. 1 is a schematical representation of the coupling between the upper carriage, the tensioning carriage, and between the laying carriage and the drive means, as provided by the invention.

For driving the upper carriage, the tensioning carriage and the laying carriage, a drive chain 52 as shown in FIG. 1 is provided, having its stationary ends secured to machine frame 54*a*. At each carriage, drive chain 52 is redirected by 180° by sprockets, or chain wheels, 56,58,60. Further, drive chain 52 is also redirected by 180° by two chain wheels, or first and second drives, 62,64, each of them having an electronically controlled drive.

Thus, drive chain 52 is guided from the fastening location on machine frame 54*b* via chain wheel 56 of upper carriage 10 to the chain wheel 62 of the drive motor for the upper carriage, and then via chain wheel 58 of tensioning carriage 12 to the chain wheel 64 of the drive for laying carriage 14 and the chain wheel 60 of laying carriage 14 back to the second fastening location on machine frame 54*b*.

Return movement of upper carriage 10, tensioning carriage 12 and laying carriage 14 is carried out e.g. by means of a suitable endless conveyer belt, i.e. conveyer belt 18. Thus, the position of upper carriage 10 is determined according to the respective control of chain wheel 62 by the electronically controlled drive, the position of the laying carriage 14 being determined by chain wheel 64.

The position of tensioning carriage 12 results from the movement of the two chain wheels 62 and 64 so that the tensioning carriage does not need a drive of its own.

The two chain wheels 62 and 64 in connection with tensioning carriage 12 allow completely independent control of the movement of the laying carriage and the upper carriage.

By corresponding control of the drives of chain wheels 62 and 64 during lay-down the nonwoven 4, stretching and stuffing, e.g. in the range of ±15% can be set continuously and without tilting, and are also variable over the whole laying width.

Figure 3:
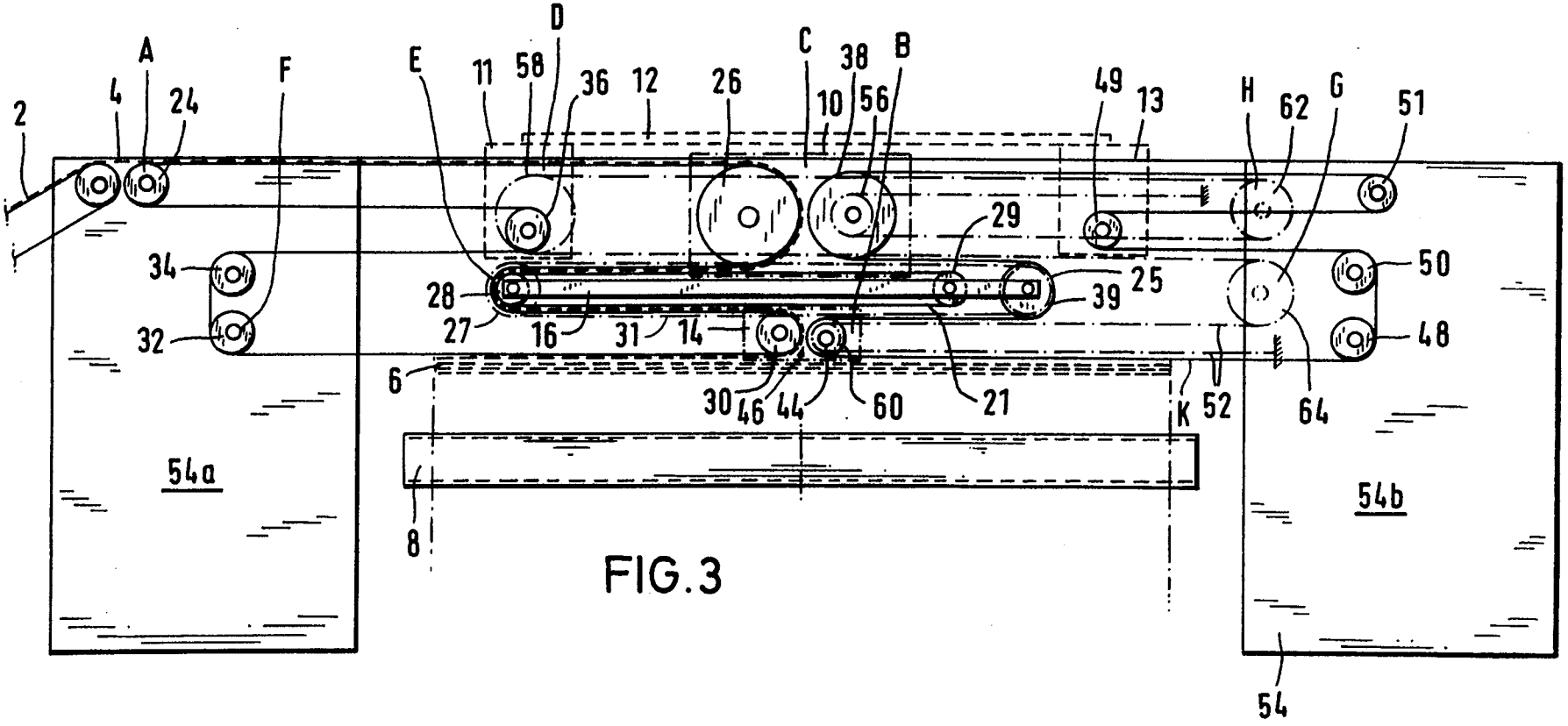
FIG. 3 shows a second embodiment of the invention; having a tensioning carriage comprising two carriage members and an additional intermediate carriage.

FIG. 3 shows an embodiment of a nonwoven laying device having a two-part tensioning carriage 12 consisting of two carriage members 11,13. Carriage member 11 has supported therein the guide roller 36 for the first conveyer belt 18, and carriage member 13, arranged at a distance from carriage member 11, has supported therein a guide roller 49 for the second conveyer belt 20. A connection is provided between the two carriage members 11,13. The upper carriage 10 is arranged between these two carriage members, with the belt guidance of the second conveyer belt 20 differing in the following manner from FIG. 2: From the guide roller 38 of upper carriage 10, the second conveyer belt 20—via a guide roller 39 pivoted at the end of a reciprocating intermediate carriage 16 opposite to guide roller 28—is moved directly to the guide roller 44 of laying carriage 14. In this arrangement, the laying carriage 14 has only one guide roller for the second conveyer belt which, when returning via the stationary guide rollers 48,50 and the guide roller 49 of carriage member 13 and a further stationary guide roller 51 pivoted in machine frame 54*b*, is moved back to the guide roller 38 of upper carriage 10.

In this embodiment, there is provided a further conveyer belt 21 for the intermediate carriage 16, which, instead of the second conveyer belt 20 in the embodiment of FIG. 2, clampingly holds the nonwoven between conveyer belt 21 and the first conveyer belt 18, transporting the fabric and guiding it about guide roller 28. For the endless conveyer belt 21, a further guide roller 29 is provided at the end opposite to guide roller 28 but before guide roller 39.

The intermediate carriage 16 is provided with a tentering chain 31 being guided at the ends of intermediate carriage 16 by chain wheels 25,27. The tentering chain is fastened to laying carriage 14 on the one hand and to upper carriage 10 on the other hand. In this manner, the position of the reciprocating intermediate carriage 16 is determined in dependence of the movements of upper carriage 10 and the laying carriage 14.

Figure 4:
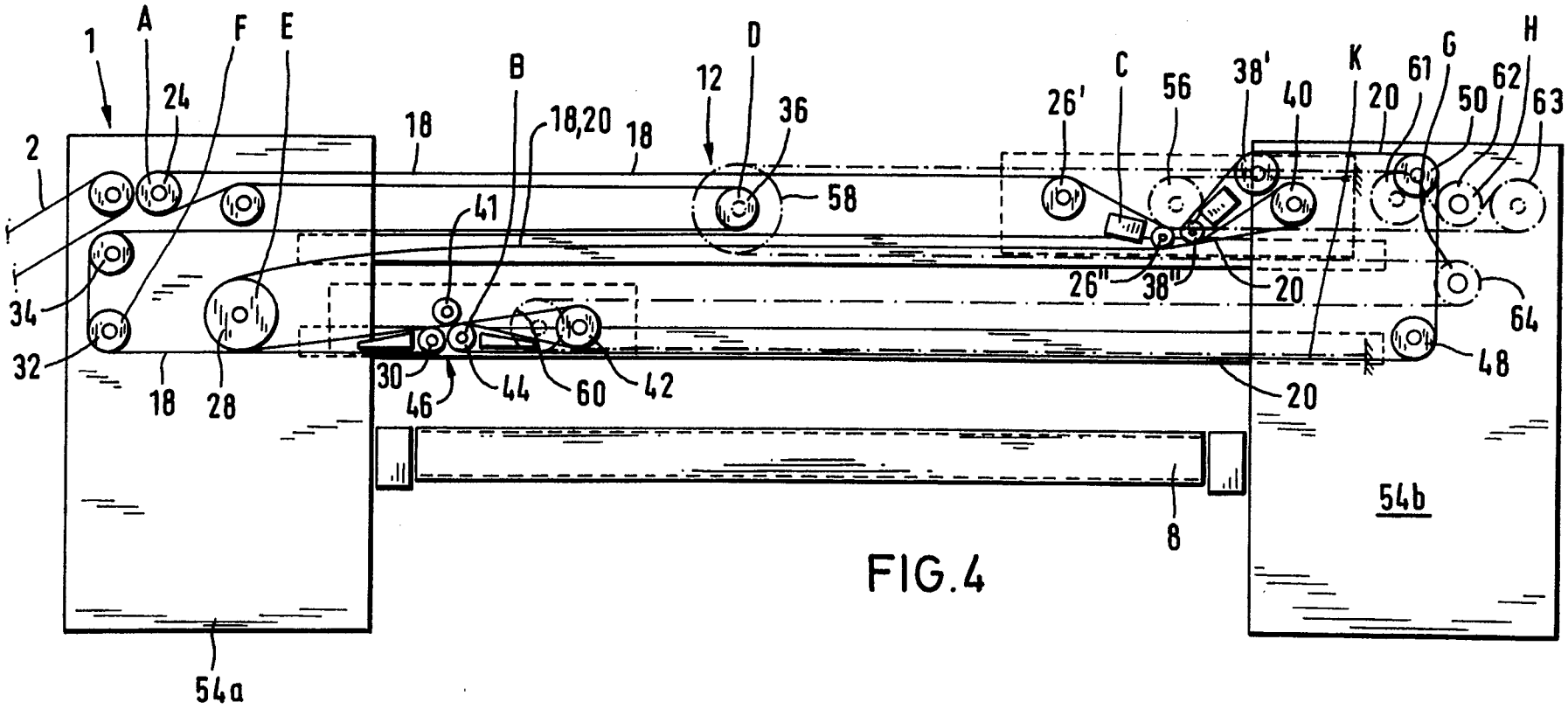
FIG. 4 shows a third embodiment of the invention, with the belt being guided differently.

FIG. 4 shows a third embodiment of the nonwoven laying device 1 with its belt guidance being substantially the same as in the embodiment of FIG. 2. The guide roller 26 for the first conveyer belt in upper carriage 10 and the guide roller 38 for the second conveyer belt in upper carriage 10 are replaced by two upper carriage guide rollers 26',2'',38',38'', respectively, the nonwoven 4 being guided between the guide rollers 26'',38'' of smaller radius. Thereby, in the intake zone before the two guide rollers 26'' and 38'', there is a large opening angle between the two conveyer belts 18 and 20, which, in this embodiment, is larger than 90°. However, this opening angle can also be only 20° while the position of the rollers 26', and 26'', is unchanged, or it can be varied as desired. The guide rollers 26' and 26'' are set off with respect to each other such that the declining portion of the first conveyer belt 18 is arranged at an acute angle to the horizontal line.

In the further course of the moving path of the nonwoven fabric, the fabric 4 is fed, while following an arcuate or also polygonal path, to the stationary guide roller 28 being larger in diameter as compared to the embodiment of FIG. 2.

In the laying carriage 14 and above the discharge location, there is supported, in addition to the guide rollers 30 and 44, a laying carriage guide roller 41 for guiding the second conveyer belt 20.

The conveyer belt 20 and the conveyer belt 21 are preferably driven only by friction, but can be driven also by being coupled to conveyer belt 18 or be provided with a drive of their own.

With respect to the drive chain 52, the chain guidance at chain wheel 62 is different from FIGS. 2 and 3 in so far as two additional guide wheels 61,63 are arranged before and after the chain wheel 62.

In the embodiments shown in FIGS. 2 to 4, the chain wheels 62 and 64 and the guide roller 24 are provided with suitable shaft encoders for transmitting speed signals to the electronic control 65.

Of course, instead of a drive chain, also a synchronous belt or the like can be used.

The chain-dotted lines in FIGS. 2 to 4 indicate a laying width and the center of the laying width, respectively. The reversal points for the movement of the laying carriage are determined by the electronic control and by driving the chain wheel 64 correspondingly.

Figure 5A:
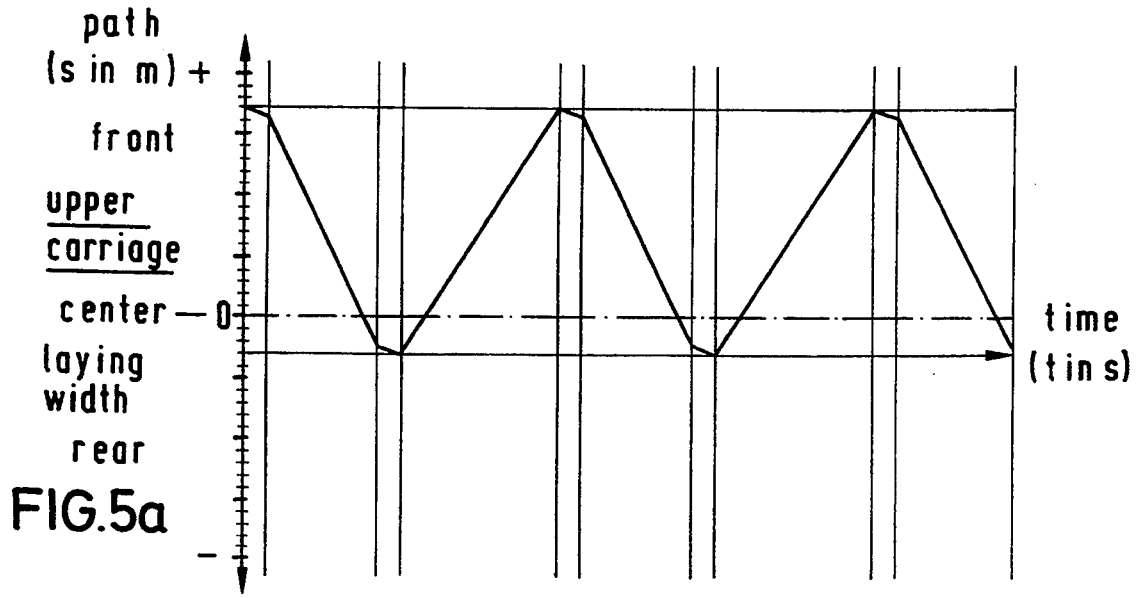
FIGS. 5*a*, 5*b*, 5*c* are path diagrams for the upper carriage, the tensioning carriage and the laying carriage.
Figure 5B:
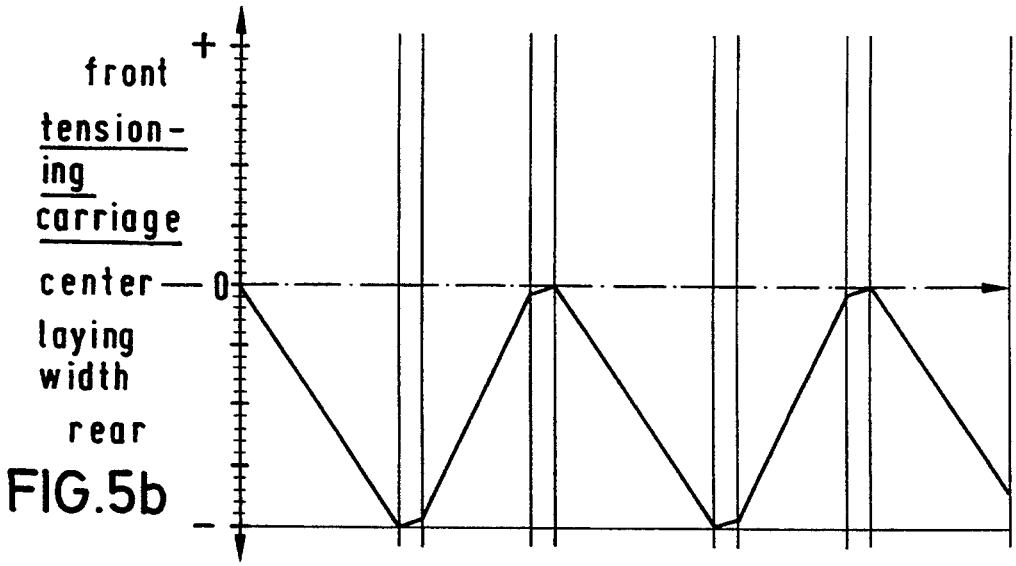
Figure 5C:
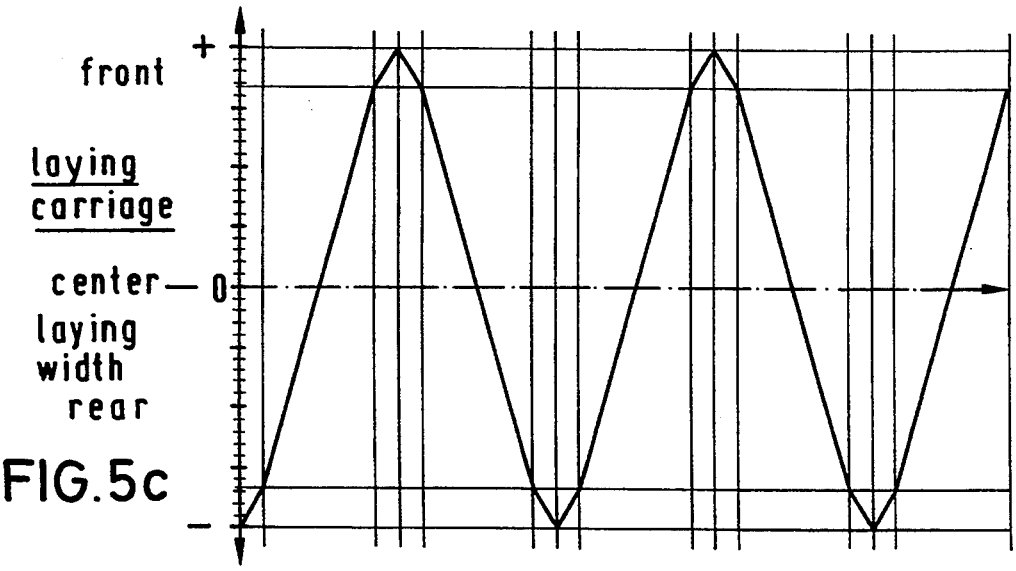

FIGS. 5*a*,5*b*,5*c* show the paths covered by the upper carriage 10, the tensioning carriage 12 and the laying carriage 14 with respect to the center of the laying width. The negative values represent a movement in the direction of the machine frame 54*a* on the feed side.

The figures show that the tensioning carriage, as compared to the laying carriage, moves back and forth only over substantially half the laying width. Also the upper carriage reciprocates only over half the laying width but with a displacement by a certain distance with respect to the center of the laying width.

As can be seen in FIG. 5*c*, the laying carriage approaches the reversal points at a reduced speed while the tensioning carriage, moving in the direction of the feed-side machine frame 54*a*, is moved in a uniform manner over the whole moving path. Only the return movement begins and ends with a slowdown phase.

According to FIG. 5*a*, the opposite case applies to the upper carriage, i.e. reduced speeds are provided for the initial phases and the end phases in the direction of movement to the machine frame on the feed side.

Figure 6A:
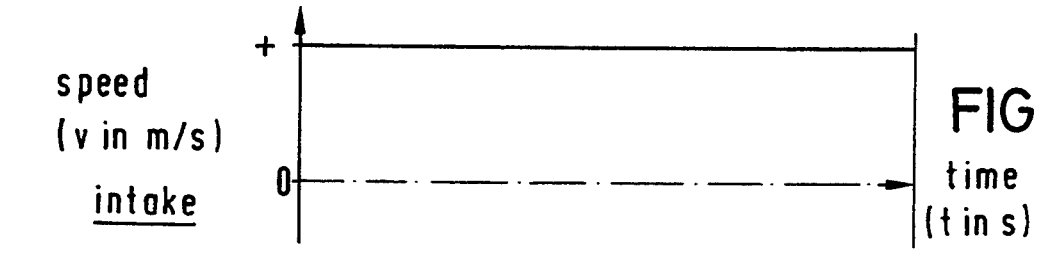
FIGS. 6*a* thru 6*e* show speed diagrams for nonwoven intake, for the toothed-belt disc of the upper carriage, and for the upper carriage, the tensioning carriage and the laying carriage.
Figure 6B:
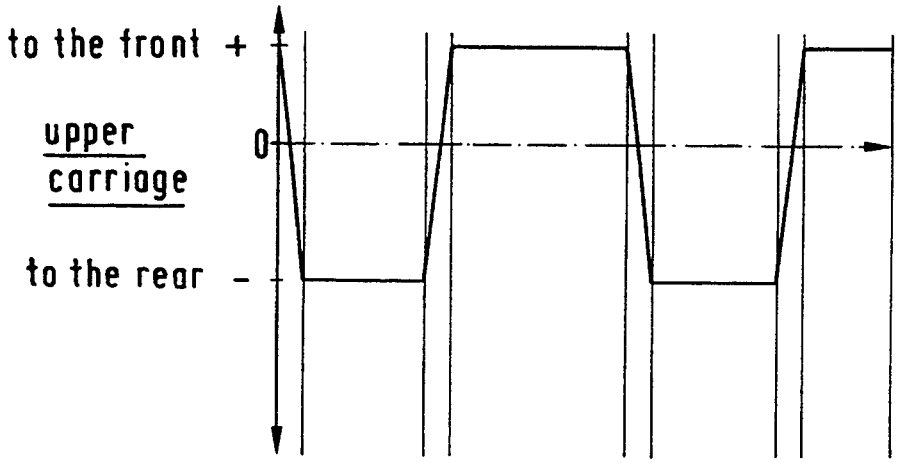
Figure 6C:
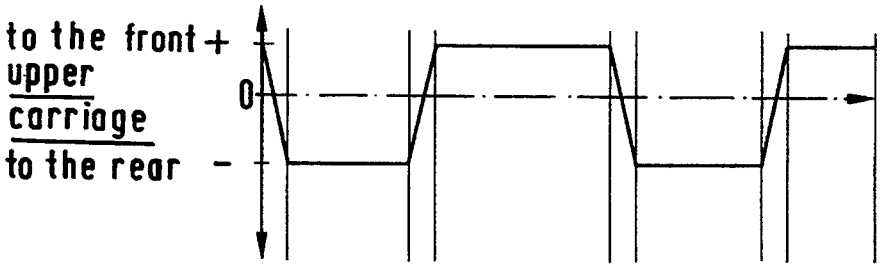
Figure 6D:
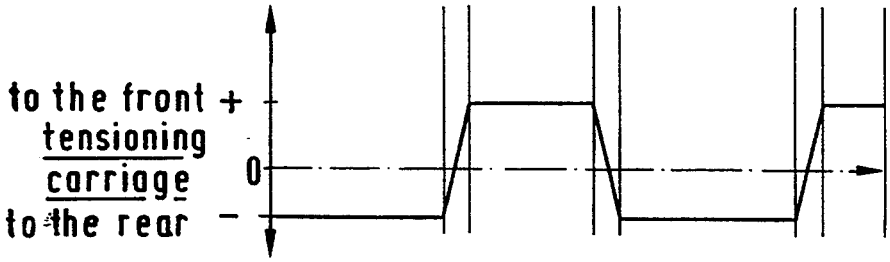
Figure 6E:
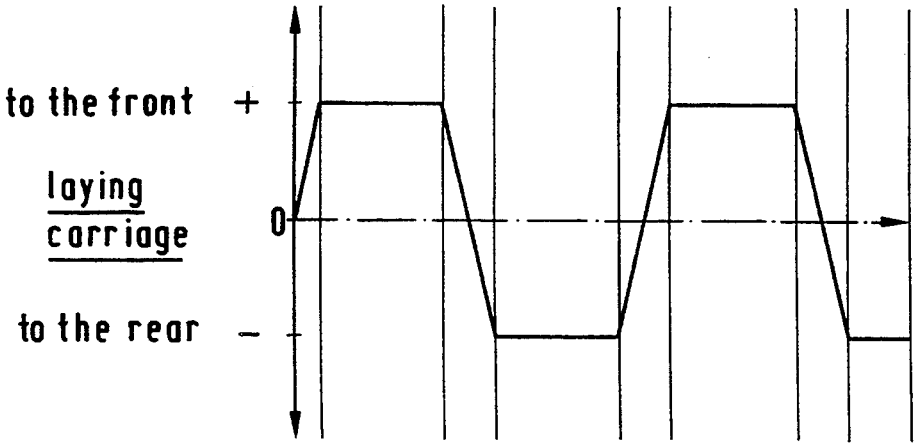
Figure 8:
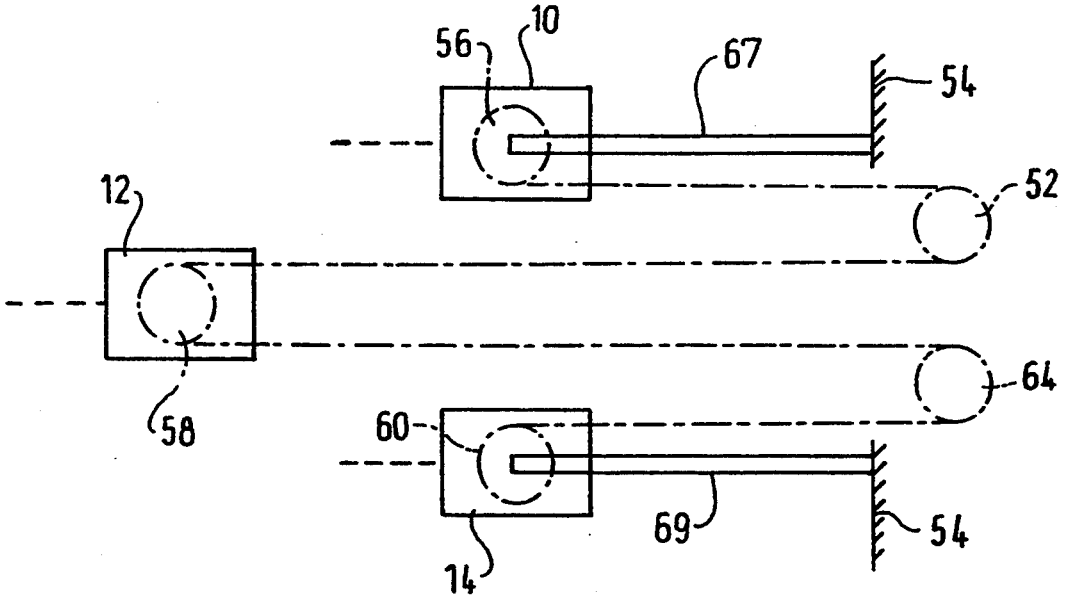
FIG. 8 shows an additional embodiment of the invention.

The appertaining speed diagrams are shown in FIGS. 6*a* to 6*c*. From FIG. 6*a*, it is evident that the intake speed of the nonwoven 4 is constant. FIG. 6*b* shows the peripheral speed of the chain wheel 62 for the upper carriage 10. FIGS. 6*c*, 6*d* and 6*e* show the speed profile of the upper carriage 10, the tensioning carriage 12 and the laying carriage 14, respectively. The maximum speed reached by laying carriage 14 after the acceleration and braking phases can be set higher than the intake speed of the nonwoven 4. FIGS. 5 and 6 are path and speed diagrams irrespective of a set stretching.

The tensioning carriage 12 serves for tensioning the conveyer belt required for the additional nonwoven storage.

In position A, the belt speed of the first conveyer belt 18 or, respectively the peripheral speed of the guide roller 24 is $V_E$. This speed is preferably constant and remains unchanged in the advance and return movement of the laying carriage.

The speed of the laying carriage in position B is composed of the belt speed $V_E$ minus or, respectively, plus speed components including a predetermined drafting, or stretching, which can be provided to be variable over the laying width. Said stretching can be positive and thus effect stretching of the fabric, or it can be negative drafting, or stretching, and thus effect stuffing of the fabric, i.e. thickening of the fabric.

With the help of chain wheel 64, the speed of the laying carriage is determined by an electronic control for controlling the speed of the laying carriage in dependence of the desired stretching or development of stretching, the braking and acceleration phases and the like.

The speed of the upper carriage on position C is controlled, with the help of chain wheel 62, according to the following relationship:

$$V_o = \tfrac{1}{2} \times (V_E - (K+1)/K \times V_L),$$

wherein K is a stretching/stuffing factor resulting from the relation between the speed $V_L$ of the laying carriage and the discharge speed $V_A$ of the nonwoven 4, with $K = V_L/V_A$. The discharge speed $V_A$ of the nonwoven 4 is dependent on the belt speed $V_E$ as well as on the speed of the upper carriage and the speed of the laying carriage.

The average speed of the laying carriage corresponds to the product of the nonwoven intake speed and the average stretching/stuffing factor.

The speed $V_{Sp}$ of tensioning carriage 12 (position D) is expressed, relative to the speeds $V_o$,$V_L$ Of the upper carriage or the laying carriage, by the following relation:

$$V_{Sp} = -(V_L + V_O)$$

The speeds in the positions B, G, C and H are determined by the electronic controls, with the speeds in the positions D, E, F and K resulting from the mechanical dependence.

FIG. 7 shows, in profile, the nonwoven as deposited on the discharge belt 6.

Figure 7A:
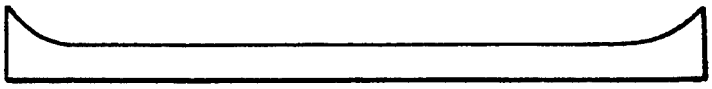
FIGS. 7*a* to 7*d* show different nonwoven profiles.

FIG. 7*a* illustrates the so-called bathtub effect in laying a nonwoven, which in conventional nonwoven laying devices is caused by slow-down of the laying carriage in the edge area.

Figure 7B:
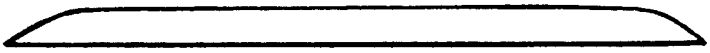

FIG. 7*b* is a sectional view of a nonwoven as obtained by the above embodiments. In FIG. 7*b*, the edge area is not thickened but is thinned in a controlled manner. This thinning of the edge area is desired because the edges become often thicker in further processing, and this effect is thus compensated.

Figure 7C:
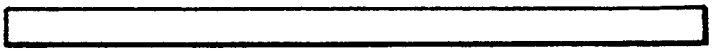
Figure 7D:
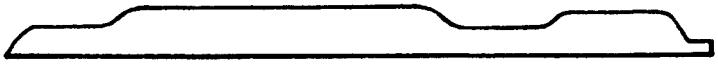

However, laying of the nonwoven can be performed continuously in uniform manner as shown in FIG. 7*c*, or, as shown in FIG. 7*d*, a non-uniform laying profile can be obtained in a controlled manner.

By way of alternative to the described drive chain 52 with the separately driven chain wheels 62,64, it is also possible to control the upper carriage 10 and the laying carriage 14 directly through linear drives 67,69. In this case, no drive chain 52 is needed; however, if the path is the same as that of drive chain 52, a cable line is used for controlling the movement of the tensioning carriage.

In a further variant of the drive, a stretching or stuffing can be set immediately by control of the speed of the conveyer belt 18 at the locations E and F. For this purpose, the guide rollers 28 and 32 or 34, respectively are driven under electronic control. A cable line is used instead of the drive chain 52, with the movement of upper carriage 10, tensioning carriage 12 and laying carriage 14 resulting exclusively from the drive of the conveyer belt 18.

What is claimed is:

1. A device for laying a stretchable nonwoven, comprising:

a substantially horizontally extending support structure;

a reciprocatable upper carriage and a reciprocatable laying carriage associated with said support structure, said upper carriage being configured for intaking and transporting the nonwoven and said laying carriage being configured for transporting and laying the nonwoven;

drive means associated with said upper and laying carriages for selectively reciprocating said upper and laying carriages;

a first conveyer belt and a second conveyor belt, each being associated with said upper and laying carriages for transporting the nonwoven from about said upper carriage to said laying carriage;

at least two guide rollers associated with said upper carriage for guiding said first conveyer belt; and said at least two guide rollers being laterally displaced and at different elevations with respect to one another for guiding a portion of said first conveyor belt in a path descending at an acute angle with respect to a horizontal line, thereby defining a first conveyor belt descending portion in said first conveyor belt.

2. The nonwoven laying device as defined in claim 1, wherein said upper carriage has at least two mutually displaced second conveyor belt guide rollers arranged therein for guiding a portion of said second conveyer belt in a path descending at an angle with respect to a horizontal line, thereby defining a second conveyor belt descending portion in said second conveyor belt, such that said second conveyer belt descending portion together with first conveyor belt descending portion defines an opening angle $\beta$ therebetween.

3. The nonwoven laying device as defined in claim 2, further comprising angle varying means associated with said first and second carriages for varying said opening angle $\beta$.

4. The nonwoven laying device as defined in claim 2, wherein said angle varying means includes said at least two guide rollers and said at least two mutually displaced second conveyor belt guide rollers and allows said opening angle $\beta$ to be approximately 20°.

5. The nonwoven laying device as defined in claim 2, wherein said opening angle $\beta$ is greater than 90°.

6. The nonwoven laying device as defined in claim 1, further comprising a stationary guide roller associated with said first and second conveyor belts, and wherein said first and second conveyor belts define an arcuate path adjacent said stationary guide roller for guiding the nonwoven.

7. The nonwoven laying device as defined in claim 1, further comprising a stationary guide roller associated with said first and second conveyor belts, and wherein said first and second conveyor belts provide a polygonal arcuate path adjacent said stationary guide roller for guiding the nonwoven.

8. The nonwoven laying device as defined in claim 1, further comprising a discharge site and a first laying carriage guide roller associated with said laying carriage positioned above said discharge site for guiding at least one of said first and second conveyor belts.

9. The nonwoven laying device as defined in claim 1, further comprising a first upper carriage guide roller associated with said upper carriage, and wherein one of said first and second conveyer belts can be guided by said first upper carriage guide roller in the same direction as that of the other of said first and second conveyor belts, and further comprising a second laying carriage guide roller associated with said laying carriage, said second laying carriage guide roller separating said laying carriage from said other conveyor belt.

10. The nonwoven laying device as defined in claim 2, wherein one of said at least two guide rollers and one of said at least two mutually displaced second conveyor belt guide rollers are arranged in substantially the same plane.

11. The nonwoven laying device as defined in claim 1, further comprising means associated with said support structure for delivering the nonwoven in a substantially horizontal direction to said upper carriage.

12. The nonwoven laying device as defined in claim 1, wherein said second conveyor belt has a first side and a second side opposite said first side, and wherein said upper carriage includes a second upper carriage guide roller contacting said first side of said second conveyor belt, a third upper carriage guide roller contacting said second side of said second conveyor belt, and said second and third upper carriage guide rollers guiding said second conveyor belt such that said second conveyor belt tangentially approaches said first conveyor belt for receiving the nonwoven therebetween.

13. The nonwoven laying device as defined in claim 1, wherein said laying carriage includes a first laying carriage guide roller for guiding one of said first and second conveyer belts.

14. A device for laying a stretchable nonwoven, comprising:

a substantially horizontally extending support structure;

a reciprocatable upper carriage and a reciprocatable laying carriage associated with said support structure, said upper carriage being configured for intaking and transporting the nonwoven and said laying carriage being configured for transporting and laying the nonwoven;

drive means associated with said upper and laying carriages for selectively reciprocating said upper and laying carriages;

a first conveyer belt and a second conveyor belt, each being associated with said upper and laying carriages for transporting the nonwoven from about said upper carriage to said laying carriage;

at least two guide rollers associated with said upper carriage for guiding said first conveyer belt; and said first conveyor belt including a substantially horizontal portion for transporting the nonwoven and a descending portion adjacent to and downstream of said substantially horizontal portion, said descending portion descending in the region of said upper carriage at an acute angle $\alpha$ with respect to a horizontal line.

* * * * *